United States Patent [19]

Stroud

[11] 4,413,745

[45] Nov. 8, 1983

[54] TRAY CADDY FOR WAITRESSES

[75] Inventor: Ray D. Stroud, Oklahoma City, Okla.

[73] Assignee: Continental Plastics, Oklahoma City, Okla.

[21] Appl. No.: 261,148

[22] Filed: May 6, 1981

[51] Int. Cl.[3] ..... A47G 23/06; B65D 21/02; B65D 1/36

[52] U.S. Cl. ..... 220/23.4; 206/563; 220/23.83; D7/3; D7/39

[58] Field of Search ..... 220/20, 23.4, 23.83, 220/23.86; 206/563; D7/3, 38, 39

[56] References Cited

U.S. PATENT DOCUMENTS

| | | | |
|---|---|---|---|
| D. 99,127 | 3/1936 | Janger | D7/38 |
| D. 101,007 | 8/1936 | Prince | D7/39 |
| D. 230,810 | 3/1974 | Ryan | D7/38 |
| 922,495 | 5/1909 | Last | D7/38 |
| 2,695,114 | 11/1954 | Wells | 220/23.4 |
| 3,754,502 | 8/1973 | Kaufman | D7/39 |
| 3,857,482 | 12/1974 | Shelton | 206/563 |
| 4,219,144 | 8/1980 | Hagelberg | 206/563 |

FOREIGN PATENT DOCUMENTS

| | | | |
|---|---|---|---|
| 126301 | 12/1947 | Austria | 220/23.4 |
| 1429895 | 12/1968 | Fed. Rep. of Germany | 220/20 |
| 257678 | 10/1948 | Switzerland | 220/23.4 |
| 3802 | of 1897 | United Kingdom | 220/20 |
| 417900 | 10/1934 | United Kingdom | 220/23.4 |
| 640435 | 7/1950 | United Kingdom | 220/23.4 |

*Primary Examiner*—George E. Lowrance

*Attorney, Agent, or Firm*—Laney, Dougherty, Hessin & Beavers

[57] ABSTRACT

An arcuately shaped caddy receptacle having a plurality of open-topped compartments and adapted for securement to the rim of a round cocktail waitress tray by means of a plurality of clips.

16 Claims, 9 Drawing Figures

TRAY CADDY FOR WAITRESSES

BACKGROUND OF THE INVENTION

1. Field of the Invention

This invention relates to accessory holders useful to waitresses serving cocktails from small, hand-carried trays, and more particularly to a snap-on type tray caddy having a plurality of variously sized, open-topped compartments, and adapted for detachable securement to the rim of a round cocktail serving tray.

2. Brief Description of the Prior Art

In the work of waitresses generally, and cocktail waitresses in particular, various accoutrements are carried and dispensed by the waitresses as patrons are served and the meal is catered. A cocktail waitress, for example, has a need to carry a sufficient amount of coinage in proper denominations so that change may be made when a customer is paying his bill. She must carry a pen or pencil for calculating the customer's bill, she must have a pocket or other receptacle for the accommodation and accumulation of tips, matches are frequently requested by customers, napkins and swizzle sticks must often be on hand, and the bills or charge tickets, both clean and those being tabulated, must be at hand and properly segregated.

In many environments of service, the level of light is such that a small penlight is essential. Moreover, in the course of keeping the items necessary to provide first-rate service in the possession of the waitress and close at hand, conditions are frequently encountered in which the customers' checks and currency collected by the waitress become dampened or wetted by inadvertently spilled drinks, and the inconvenience of transferring soggy currency and checks back and forth between the customer and waitress is encountered. Moreover, damp or soggy checks are difficult to process in the cash register. In sum, under most conditions of service, the waitress is required to be digitally facile and dexterous, and partakes of some of the occupational hazards of a juggler.

To aid the waitress in rendering better service, as well as to improve and maintain waitress morale, a variety of caddy or tray-type containerized systems have been devised to accommodate the various accoutrements which the waitress must handle in the course of service, and to place them within reach of the waitress and make them accessible in a more desirable fashion. Such caddies and trays include, for example, those of the type which are described and/or illustrated in Robinson et al. U.S. Pat. No. D-220,644; McKay U.S. Pat. No. D-200,547; Fredrickson U.S. Pat. No. D-183,165; McKay U.S. Pat. No. 3,229,946; Brocato U.S. Pat. No. 3,670,938; Fehn U.S. Pat. No. D-210,478; Gottsegen U.S. Pat. No. D-240,578; and McCaffrey U.S. Pat. No. D-257,113. Some of these patents, such as the McCaffrey food and service caddy and the McKay service receptacle, are designed for attachment to a cocktail tray or service tray of the type having an upwardly and outwardly projecting rim or flange around the outer periphery thereof. Others, such as that shown in the Robinson patent, are intended to be rested upon and within the tray, thereby affording perhaps greater stability and better support than the rim-supported, suspended type of caddy, but requiring the utilization of some of the space on the serving tray which could otherwise be used for drinks or food.

Many of the described trays, receptacles and caddies are compartmentalized to facilitate the carriage therein of a plurality of items of varying shapes and sizes. The Robinson tray caddy, for example, has a series of small compartments therein which are shaped to accommodate coinage of varying denominations and thus of different sizes. The Robinson caddy also provides a small compartment for the accommodation of book matches, and a compartment in which cash or currency can be located.

BRIEF DESCRIPTION OF THE PRESENT INVENTION

The present invention provides an improved tray caddy which can be quickly and very securely attached to the peripheral rim or lip of a serving tray, and which is anchored to the serving tray, upon attachment, in a firm status which permits a major portion of the caddy to be cantilevered outwardly from the serving tray, thereby avoiding the problem of occupying a portion of the total inside supporting surface of the tray. Moreover, the tray caddy of the invention is configured to maximize ease of access by the waitress to a number of variously configured and sized articles which can be compartmentalized within the caddy during its use.

Broadly described, the tray caddy of the invention includes an inner peripheral wall adapted to register with the outer peripheral portion of a serving tray. The caddy further includes a back wall which is of complementary configuration to the front wall, with the front and back walls of the caddy being interconnected by end walls which project outwardly from the peripheral rim of the serving tray when the caddy is attached thereto. Between the front and back walls of the caddy are a plurality of partitioned compartments which are selectively sized to accommodate different articles and devices which are handled at one time or another in the course of service by the waitress. The caddy is retained firmly cantilevered from the peripheral rim of the serving tray by means of a plurality of engagement clips which cooperate with projecting hook portions formed on the caddy at several spaced locations so that the rim of the serving tray is firmly clamped to the caddy.

An important object of the present invention is to provide a very useful and versatile tray caddy which can be employed by waitresses in the course of service of beverages or foods to hold and accommodate various accoutrements used by the waitress in the rendition of such service.

A further and more specific object of the invention is to provide a tray caddy which can be very quickly and firmly attached to the peripheral rim or flange carried on serving trays to permit the caddy to project outwardly in cantilever fashion from the rim of the tray, and to be stably supported in this position.

An additional object of the invention is to provide a compartmentalized waitress's tray caddy which is constructed to provide, in a minimum of space, compartments for the accommodation of active and inactive checks, a pencil or ballpoint pen, a cigarette lighter, a penlight and napkins. Further, the caddy is provided with drainage means which assures that water dropped on checks or napkins quickly drains away without excessive soiling or undesirable sogginess at the time of exchange of the checks or dispensation of the napkins.

Another object of the invention is to provide a tray caddy which, by reason of a staggered or stepped construction, displays and renders more easily accessible the various items which must be reached and handled by a waitress in the course of rendering food or beverage service to customers.

A further object of the invention is to provide a tray caddy for use by waitresses, which caddy can be quickly and easily snapped firmly to the rim of a serving tray without the use of tools.

Yet another object of the invention is to provide a tray caddy for use by waitresses in conjunction with a serving tray which does not utilize any of the inner surface area of the tray when the caddy is in use, thus not preempting any of the space used for carrying food or drinks on the tray.

An additional object of the invention is to provide a tray caddy which is very light in weight, yet sturdy and durable in construction, so that it can be dropped to the floor by a waitress with little likelihood of damage occurring.

The foregoing objects and advantages, as well as additional benefits and objectives, will become better understood and appreciated as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
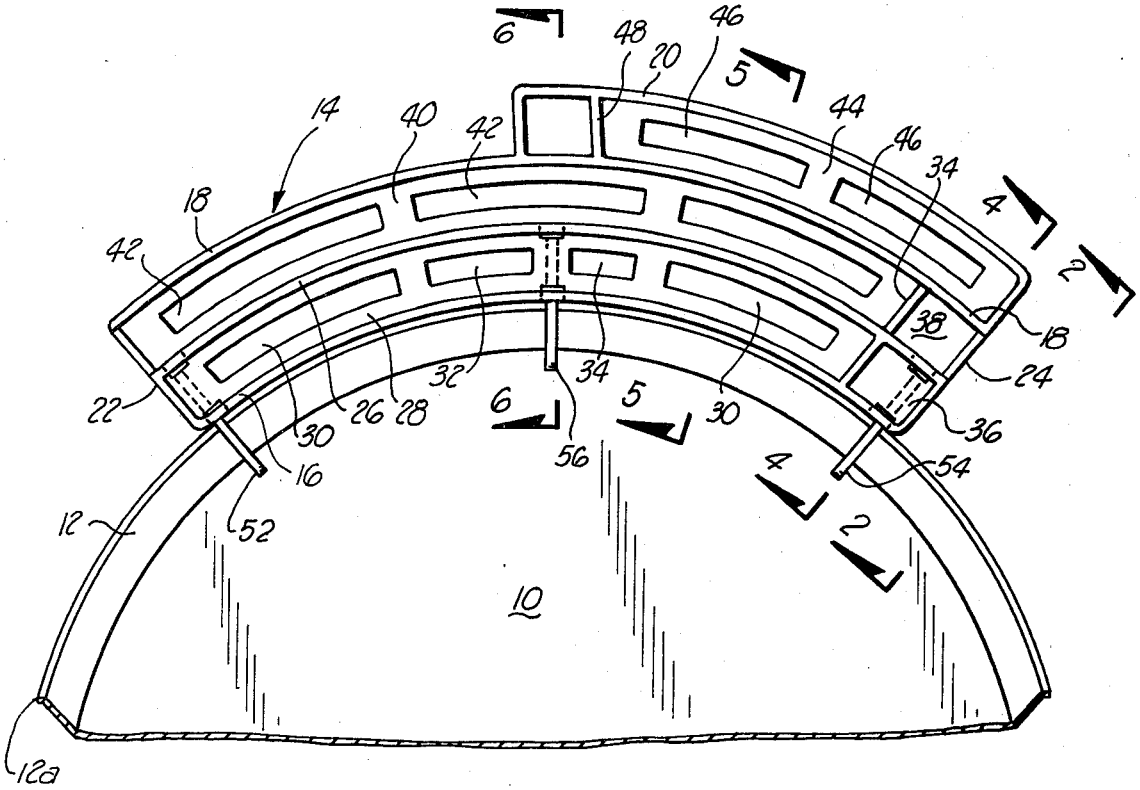
FIG. 1 is a plan view which illustrates the tray caddy of the invention as it appears when attached to a round, disc-shaped cocktail serving tray.

Referring to FIG. 1 of the drawings, a segment of a round cocktail waitress tray is illustrated and includes a flat, round horizontally extending central portion at 10. The tray 10 includes an outwardly and upwardly slanting rim 12 which carries a peripheral lip 12*a* at the upper edge thereof. Such trays are used for carrying cocktails and food from a bar to the customers' tables by cocktail waitresses.

The tray caddy of the present invention is designated generally by reference numeral 14 and is shown in FIG. 1 in its operative position attached to the rim 12 of the tray 10. The tray caddy includes an arcuate, upstanding inner wall 16 which is curved through an arc of from about 60° to 120°, and is complementary in curvature to the rim 12. The tray caddy 14 also includes a main outer wall 18 which is curved on the same center of curvature as the arcuate inner wall 16 and projects substantially parallel to the inner wall in a direction normal to the projection of the principal plane of the central portion of the tray 10. A foreshortened outermost wall 20 is also arcuately curved on the same center of curvature as the inner wall 16 and the main outer wall 18. The wall 20 extends substantially parallel to the walls 16 and 18 and is spaced radially outwardly from the main outer wall 18. It will be noted that the main outer wall 18 and the foreshortened outermost wall 20 are both stepped upwardly from the level at which the inner wall 16 is located.

Figure 2:
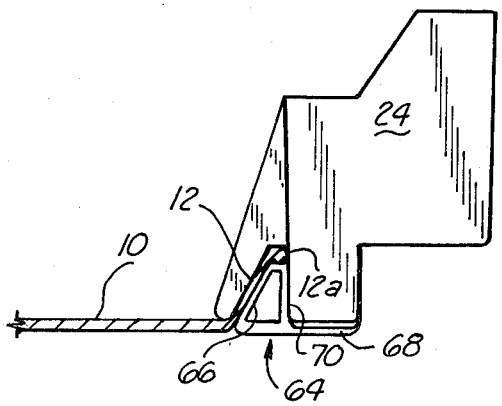
FIG. 2 is a sectional view taken along line 2—2 of FIG. 1.
Figure 3:
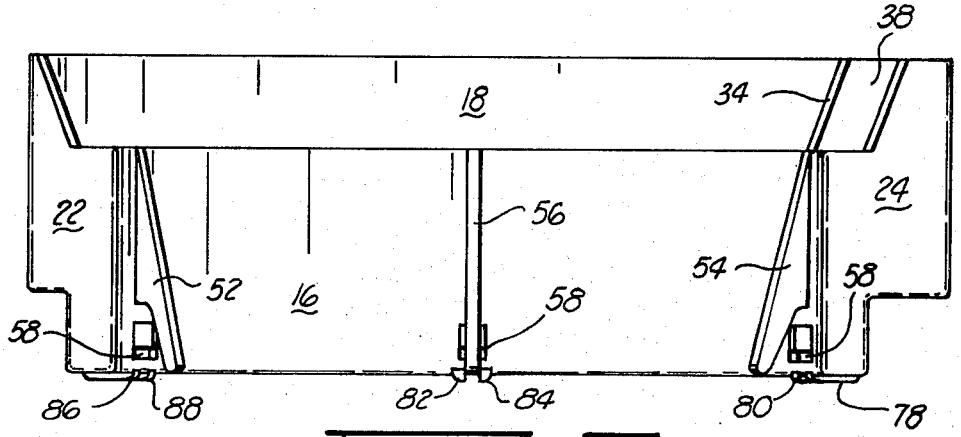
FIG. 3 is a view in elevation of the inner side of the tray caddy as it appears when detached from the rim of a serving tray.

A first end wall 22 interconnects one end of the inner wall 16 with the radially aligned end of the arcuate outer wall 18. The configuration of the end wall 22 is best illustrated in FIG. 3 of the drawings. The opposite end of the inner wall 16 is interconnected with the main outer wall 18 and the foreshortened outermost wall 20 at the ends of the latter walls by means of a second end wall 24. The configuration of the end wall 24 is best illustrated in FIGS. 2 and 3. Between the arcuate inner wall 16 and the main outer wall 18 is an arcuate intermediate wall 26. The arcuate intermediate wall 26 is formed on the same center of curvature as the outer walls which have been described, and is positioned substantially midway between the inner wall 16 and the main outer wall 18. It will be noted in referring to FIG. 5 that the inner wall 16 and the intermediate wall 26 are of substantially the same height, and that the main outer wall 18 and the foreshortened outermost wall 20 are also of substantially the same height, but, as noted above, at an elevated position relative to the arcuate inner wall 16. The arcuate intermediate wall 26 has its opposite ends connected to the end walls 22 and 24 as illustrated in FIG. 1.

The tray caddy further includes an innermost, first bottom wall 28 which extends between the lower edges of the arcuate inner wall 16 and the arcuate intermediate wall 26 and forms, with these walls, an open-topped compartment. The first innermost bottom wall 28 has a pair of elongated arcuate slots 30 formed therein to permit fluid flow into and from chambers formed by the bottom wall and the inner arcuate wall 16 and intermediate arcuate wall 26. Similarly, a pair of relatively shorter slots 32 is formed relatively nearer to the center of the innermost bottom wall 28.

Figure 4:
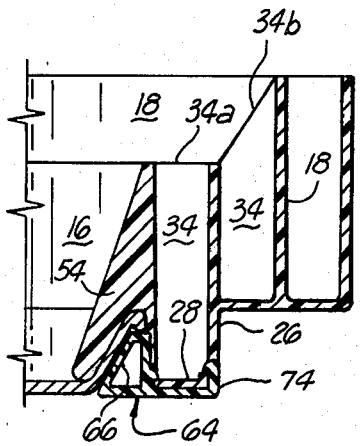
FIG. 4 is a sectional view taken along line 4—4 of FIG. 1.

Near one end of the tray caddy 14, a radial partition wall 34 projects radially outwardly from the inner wall 16 through the intermediate wall 26 to the main outer wall 18. As shown in FIG. 4, the intermediate partition wall 34 has a substantially horizontally extending top edge portion 34*a* extending between the inner wall 16 and the intermediate wall 26 and has an upwardly and rearwardly inclined top edge portion 34*b* extending between the top edge of the intermediate wall 26 and the top edge of the main outer wall 18. There is thus defined, as best illustrated in FIG. 1, two relatively small compartments 36 and 38 which are stepped or offset from each other and which function in the accommodation of such items as book matches, a small penlight, a cigarette lighter or swizzle sticks or stirrers stood on end.

Figure 5:
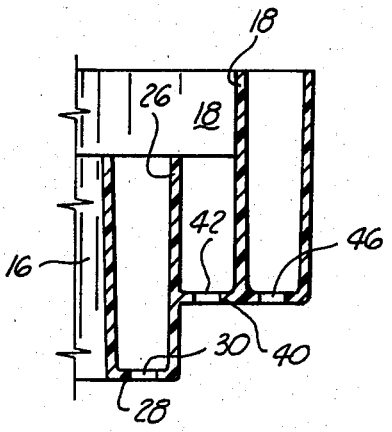
FIG. 5 is a sectional view taken along line 5—5 of FIG. 1.

An arcuate intermediate bottom wall 40 extends from one end of the tray to the other and interconnects a medial portion of the intermediate wall 26 with the lower edge of the main outer wall 18 as best illustrated in FIG. 5. It will thus be perceived in referring to FIGS. 4–6 that the intermediate bottom wall 40 is stepped or tiered upwardly from the innermost bottom wall 28.

The intermediate bottom wall 40 is slotted at longitudinally spaced intervals therealong by a plurality of slots each having the numerical designation 42, and illustrated in FIG. 1.

A radially outer bottom wall 44 extends from the lower edge of the main outer wall 18 to the lower edge of the foreshortened outermost wall 20. The radially outermost bottom wall 44 defines a pair of longitudinally spaced elongated slots 46. Extending across an unslotted portion of the bottom formed by radially outermost bottom wall 44 between the main outer wall 18 and the foreshortened outermost side wall 20 is a partition wall 48. The partition wall 48, foreshortened outermost wall 20, main outer wall 18 and radially outermost bottom wall 44 form a small compartment 49 which also can be used to contain either matches, a penlight, a cigarette lighter, swizzle sticks, straws or the like.

Figure 6:
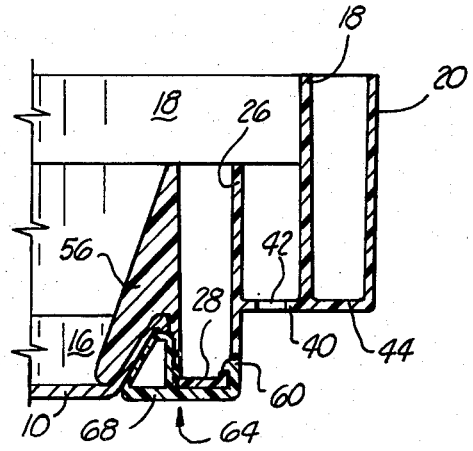
FIG. 6 is a sectional view taken along line 6—6 of FIG. 1.

It will be noted in referring to FIGS. 4–6 that the tray caddy of the invention is configured to provide a plurality of tiered compartments of various sizes, with the stepped effect thus included in the structure affording ready access by the waitress to items carried in the radially inner compartments as well as to the most elevated items which are carried in the elevated, radially outer compartments or chambers.

In order to secure the caddy 14 to the rim 12 of the tray 10, a pair of downwardly and inwardly projecting nose portions 52, 54 and 56 are secured to and formed integrally with the arcuate inner wall 16 at locations adjacent the end walls 22 and 24. The central downwardly and inwardly projecting nose portion 56, shaped substantially identically to the noses 52 and 54, is provided at the center of the caddy 14 and projects radially inwardly from the arcuate inner wall 16. Each of the noses 52, 54 and 56 defines a generally triangular space 57 with the arcuate inner wall 16, which space is located adjacent the lower end of the respective nose (see FIG. 7). This generally triangularly shaped space accommodates the upwardly and outwardly projecting rim 12 of the tray 10, as well as the lip **12*a* formed at the top edge of the rim as shown in FIG. 2**.

In radial alignment with each of the triangular slots 57 defined between the noses and radially inner wall 16 of the caddy 14, the radially inner wall has an opening or recess 58 formed therethrough at a location adjacent the intersection of the inner wall 16 with the bottom wall 28. A group of second recesses or openings 60 are formed in the intermediate wall 26, with each recess 60 being in alignment with each of the triangular spaces defined between the respective noses and the inner arcuate wall 16, and adjacent the intersection of the intermediate wall 26 with the bottom wall 28. At one boundary of each of the recesses or openings 60, the bottom wall 28 carries an abutment flange 62.

Figure 7:
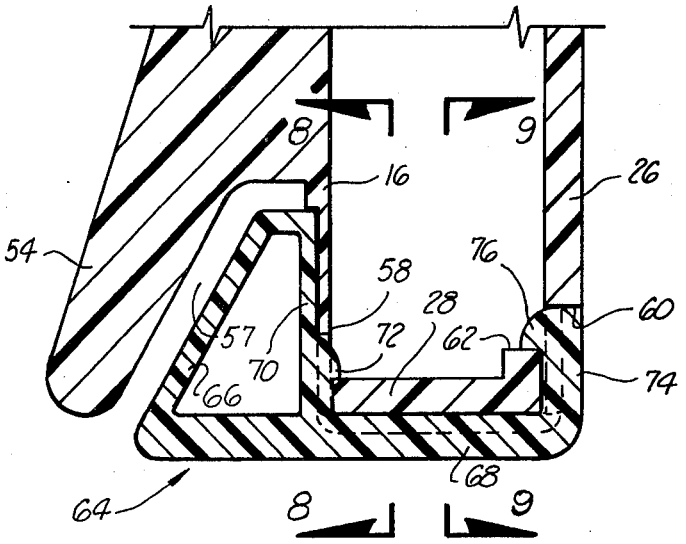
FIG. 7 is a sectional view enlarged to illustrate certain details of structure which are correspondingly found in smaller scale in the sectional view shown in FIG. 6.
Figure 8:
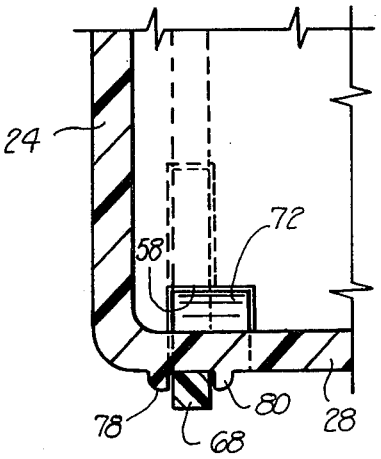
FIG. 8 is a sectional view taken along line 8—8 of FIG. 7.
Figure 9:
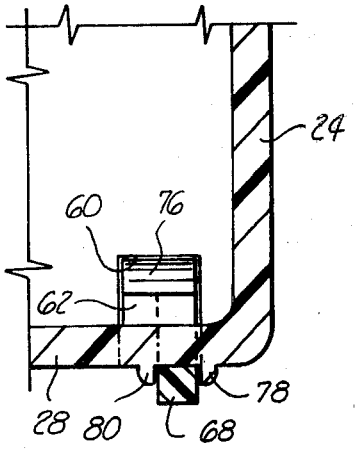
FIG. 9 is a sectional view taken along line 9—9 of FIG. 7.

The described openings 58 and 60 in the inner wall 16 and intermediate wall 26 function to accommodate three retainer clips designated generally by reference numeral 64. Three of the retainer clips 64 are utilized in correspondence to each of the three noses 52, 54 and 56, and are aligned with these noses and with the respective wall openings 58 and 60 associated with, and in horizontal alignment with, the major plane of eahc of the noses for the purpose of locking the caddy 14 to the rim 12 of the tray 10. As shown in FIGS. 2 and 7, each of the clips 64 includes an inclined, radially inner side 66 which is spaced from the adjacent, inclined radially lower edge of the respective nose 52, 54 or 56 so that the rim 12 of the tray 10 is received in the space between the web 66 and the respective nose. The inclined inner side 66 of each clip 64 intersects one end of a base portion 68 of the clip 64 as shown in FIGS. 2 and 7. Projecting normally upwardly from the base portion 68 of each of the clips 64 is a vertical member 70 joined at its upper end to the inclined inner side 66. The vertical member 70 carries a radially outwardly projecting tab 72 which has a beveled upper edge enabling the tab to be snapped into the respective opening 58 when the clip 64 is assembled to the caddy 14 in the manner illustrated in FIG. 7. The base portion 68 of each clip 64 also has a vertically extending radially outer side 74 which projects upwardly to the location of the respective opening or recess 60, and at that point carries an inwardly projecting tab 76 having a beveled upper surface which enables this tab to be snapped into the opening 60 so that the tab bears against the flange 62 at one side of this opening. To further aid in retaining the clips 64 in position, the bottom wall 28 of the caddy 14 includes three pairs of downwardly projecting, horizontally spaced ribs 78–80, 82–84 and 86–88, as best illustrated in FIGS. 3, 8 and 9.

It will be perceived in referring to FIGS. 2 and 7 that the clips 64 can be quickly snapped onto the lower, radially inner side of the caddy 14 and, in cooperation with the noses 52, 54 and 56, function to firmly affix the caddy to the rim 12 of the tray 10.

In the use of the tray caddy 14, the retainer clips 64 are snapped into their operative position on the lower side of the caddy by pressing them into the positions illustrated in the drawing in which the tabs 72 and 76 snap into the respective openings or recesses 58 and 60 in the inner wall 16 and intermediate wall 26. When the retainer clips have been thus positioned, they will, as previously described, define a space with the several nose portions 52, 54 and 56 with which they are in alignment, and each of these spaces is substantially complementary in configuration to the outer and inner peripheral rim 12 of the service tray. Thus, the rim of the tray can be accommodated in these spaces and the caddy is thus tightly retained or supported on the tray and projects outwardly therefrom in cantilevered fashion.

In assembly the caddy to the tray, the nose portions 52, 54 and 56 will first be placed over the peripheral lip of the serving tray and the retainer clips 64 then snapped into position.

With the caddy 14 secured to the outer periphery of the tray in the manner described, the apparatus is ready for use by the waitress in rendering service. The caddy can be used to contain the checks, tickets, bills or the like used to tabulate the charges of a customer, and the compartmentation allows such checks to be segregated into those which may be termed "working checks" upon which entries have been made, or clean checks which are available to the waitress to start a new account with a different customer. The slots which are formed in the bottom walls of the caddy assure that any excess liquid which may accumulate in the caddy or on its contents as a result of spillage of drinks or the like can drain from the compartments in which the checks are contained. Moreover, this slotted construction enables air to circulate through the compartments to aid in keeping the checks dry. This is an important advantage of the present invention since wet checks do not process well in many cash registers and slow down service with resultant customer dissatisfaction.

Other compartments of the caddy can be used to accommodate cigarette lighters, penlights, stirrers, straws and napkins. The size of the particular compartments involved will, of course, determine the particular item which is carried therein.

It will be noted that the staggered or tiered construction of the caddy assures that those items carried in compartments toward the radially outer side of the caddy will be readily accessible, despite the placement of other items in the radially inner compartments.

The caddy is preferably constructed as an integrally molded plastic structure, and as such it is light-weight but is quite strong mechanically so that it can be dropped without incurring damage.

The caddy can be dismounted from the serving tray for purposes of allowing the tray to be cleaned, or to allow the caddy to be transferred to the tray of a different waitress if this should be desired. Alternatively, it is within the scope of the invention to integrally mold caddy and tray as a single unit.

Although a preferred embodiment of the invention has been herein described in order to set forth in exemplary fashion the basic principles which underlie the invention, various changes and innovations in the illustrated and described structure can be made without departure from these basic principles. For example, various materials of construction can be utilized, and the serving tray can be made rectangular as well as round. Such innovations as these are therefore deemed to be circumscribed by the spirit and scope of the invention except as the same may be necessarily limited by the appended claims or reasonable equivalents thereof.

What is claimed is:

1. A waitress' tray caddy adapted for attachment to a serving tray comprising:
- an inner wall having an upper edge and a lower edge and adapated to register with the outer peripheral portion of a serving tray;
- an outer wall having an upper edge and a lower edge and spaced from the inner wall;
- an intermediate wall between said inner and outer walls and having an upper edge and a lower edge;
- bottom wall means extending between and interconnecting the lower edges of the inner wall and the outer wall, said bottom wall means comprising:
  - a first horizontally extending bottom wall extending from the lower edge of said inner wall to the lower edge of said intermediate wall; and
  - a second horizontally extending bottom wall extending from a location spaced upwardly from the lower edge of the intermediate wall to the lower edge of said outer wall;
- end walls extending between the inner wall and the outer wall;
- partition means between the inner wall and the outer wall and above the bottom wall means and dividing the space between the inner and outer walls into a plurality of vertically tiered chambers for receiving, and making horizontally accessible, a plurality of articles to be served from the tray caddy;
- retainer clip means snap-attachable to the inner wall and to the first horizontally extending bottom wall and including a portion extending beneath said first horizontally extending bottom wall for supporting the caddy upon a surface upon which a serving tray carrying the caddy is rested; and
- nose means projecting from the inner wall and cooperating with said retainer clip means for retainer the caddy attached in a cantilevered fashion to the outer peripheral portion of a serving tray.

2. A waitress' tray caddy as defined in claim 1 wherein said first and second bottom walls are slotted at the location of at least one of said chambers to facilitate fluid transfer to and from said one chamber.

3. A waitress' tray caddy as defined in claim 1 wherein said downwardly extending nose means includes a plurality of nose portions secured to said inner wall and spaced therealong, each of said nose portions projecting away from the inner wall and defining a tray-receiving, downwardly opening space with said snap attachable retainer clip means to receive a portion of an attached serving tray in said space.

4. A waitress' tray caddy as defined in claim 1 wherein said inner and outer walls are arcuate, substantially parallel and formed on the same center of curvature, and wherein said partition means includes at least one partition wall extending radially with respect to said inner and outer walls.

5. A waitress tray caddy as defined in claim 1 and further characterized as including a foreshortened outermost wall of substantially shorter length than said outer wall and spaced from said outer wall and interconnected thereto by said bottom wall means and one of said end walls.

6. A waitress' tray caddy as defined in claim 1 wherein said nose means includes a plurality of nose portions secured to said inner wall and spaced therealong, each of said nose portions projecting away from the inner wall and defining a downwardly opening tray-receiving space with said snap attachable retainer clip means to receive a portion of an attached serving tray in said space.

7. A waitress' tray caddy adapted for attachment to a serving tray comprising:
- an inner wall having at least one opening therethrough and having an upper edge and a lower edge and adapated to register with the outer peripheral portion of a serving tray;
- an outer wall having an upper edge and a lower edge and spaced from the inner wall;
- bottom wall means extending between and interconnecting the lower edges of the inner wall and the outer wall;
- end wall extending between the inner wall and the outer wall;
- partition means between the inner wall and the outer wall and above the bottom wall means and dividing the space betweeen the inner and outer walls into a plurality of chambers;
- retainer clip means snap-attachable to the inner wall and bottom wall means and including:
  - a base portion;
  - an inclined side portion extending along said nose means and spaced therefrom in the direction from said inner wall;
  - a vertical side extending normal to said base portion and abutting said inner wall; and
  - a tab carried on said vertical side and projecting into the opening through said inner wall; and
- nose means aligned with the opening in said inner wall and projecting from the inner wall and cooerating with said retainer clip means for retainer the caddy attached to the outer peripheral portion of a serving tray.

8. A waitress' tray caddy as defined in claim 7 and further characterized as including:

an intermediate wall between the inner and outer wall; and wherein said bottom wall means includes:

a first horizontally extending bottom wall extending from the lower edge of said inner wall to the lower edge of said intermediate wall; and a second horizontally extending bottom wall extending from a location spaced upwardly from the lower edge of the intermediate wall to the lower edge of said outer wall.

9. A waitress' tray caddy adapted for attachment to a serving tray comprising:

an inner wall having an upper edge and a lower edge and adapted to register with the outer peripheral portion of a serving tray;

an outer wall having an upper edge and a lower edge and spaced from the inner wall;

an intermediate wall between the inner and outer walls and having an upper edge and a lower edge;

a first horizontally extending bottom wall extending from the lower edge of said inner wall to the lower edge of said intermediate wall;

a second horizontally extending bottom wall extending from a location spaced upwardly from the lower edge of the intermediate wall to the lower edge of said outer wall;

end walls extending between the inner wall and the outer wall;

partition means between the inner wall and the outer wall and above the bottom walls and dividing the space between the inner and outer walls into a plurality of chambers;

nose means projecting from the inner wall; and retainer clip means snap-attachable to the inner wall and to said first horizontally extending bottom wall, said clip means including:

a base portion;

an inclined side portion extending along said nose means and spaced therefrom in the direction of said inner wall;

a first vertical side extending normal to said base portion and abutting said inner wall;

a tab carried on said first vertical side and extending into the opening defined by said inner wall;

a second vertically extending side extending normal to said base and abutting said intermediate wall; and a second tab carried on said second vertically extending side and extending into the opening defined by said intermediate wall, said nose means cooperating with said retainer clip means for retaining the caddy attached to the outer peripheral portion of a serving tray.

10. A waitress' tray caddy as defined in claim 9 and further characterized as including a pair of spaced ribs projecting downwardly from said first horizontally extending bottom wall on opposite sides of the base portion of said clip means.

11. A waitress' tray caddy adapted for attachment to a serving tray comprising:

an inner wall having an upper edge and a lower edge and adapted to register with the outer peripheral portion of a serving tray;

an outer wall having an upper edge and a lower edge and spaced from the inner wall;

bottom wall means extending between and interconnecting the lower edges of the inner wall and the outer wall;

end walls extending between the inner wall and the outer wall;

partition means between the inner wall and the outer wall and above the bottom wall means and dividing the space between the inner and outer walls into a plurality of chambers;

a plurality of nose portions secured to said inner wall and spaced therealong, each of said nose portions projecting away from the inner wall;

retainer clip means snap-attachable to the inner wall and to the bottom wall means and cooperating with said nose portions for retaining the caddy attached to the outer peripheral portion of a serving tray, said clip means including a plurality of retainer clips corresponding number to said nose portions, and each aligned on said caddy with said nose portions, each of said retainer clips including:

a base portion;

an inclined side portion extending along the respective aligned nose portion and spaced therefrom in the direction of said inner wall, said inclined side portion defining with the respective aligned nose portion, a tray-receiving space adapted to receive a portion of an attached serving tray in said space; and a vertical side extending normal to said retainer clip base portion and snap-engaged with said inner wall.

12. A waitress' tray caddy as defined in claim 11 and further characterized as including:

an intermediate wall between the inner and outer wall and having an upper edge and a lower edge; and wherein said bottom wall means includes:

a first horizontally extending bottom wall extending from the lower edge of said inner wall to the lower edge of said intermediate wall; and a second horizontally extending bottom wall extending from a location spaced upwardly from the lower edge of the intermediate wall to the lower edge of said outer wall.

13. A waitress' tray caddy as defined in claim 12 wherein said inner wall and said intermediate wall each define a plurality of openings; and wherein each of said retainer clips further includes:

a first tab carried on said vertical side and projecting into one of said openings in said inner wall;

a second vertically extending side; and a second tab carried on said second vertically extending side and projecting into one of said openings in said intermediate wall.

14. A waitress' tray caddy as defined in claim 13 and further characterized as including a plurality of pairs of spaced ribs secured to, and projecting downwardly from, said first horizontally extending bottom wall, each of said rib pairs including ribs lying on opposite sides of one of said retainer clip base portions.

15. A waitress' tray caddy as defined in claim 14 wherein said inner and outer walls are arcuate, substantially parallel and formed on the same center of curvature, and wherein said partition means includes at least one partition wall extending radially with respect to said inner and outer walls.

16. A caddy for containing waitresses' service accoutrements comprising:

an arcuate inner wall adapted to register with the outer peripheral portion of a round serving tray and including an upper edge and a lower edge, said inner wall defining an opening therethrough;

a main arcuate outer wall of comlementary configuration to the inner wall and spaced from the inner wall, said arcuate outer wall having an upper edge and a lower edge;

a foreshortened outermost wall spaced from the main outer wall;

partition means between said inner and outer walls and partitioning the space between said inner and main outer walls into a plurality of compartments;

bottom wall means interconnecting the inner wall, the main outer wall, the partition means and the foreshortened outermost wall in a stepped, offset arrangement in which the tops and bottoms of the main outer and foreshortened outermost walls are tiered above the respective upper and lower edges of the inner wall, and said compartments are located at different vertical levels for positioning articles contained therein in a vertically staggered and offset relationship facilitating easy access thereto;

nose means secured to and projecting inwardly from said inner wall; and clip means detachably connected to the inner wall of the caddy by engagement of a portion thereof with said opening in said inner wall, said clip means being disposed and located between said inner wall and a portion of said nose means and defining with said nose means a downwardly opening space for detachably mounting the caddy on the outer peripheral portion of a round serving tray.

* * * * *